United States Patent [19]

Dworkin

[11] 4,375,263

[45] Mar. 1, 1983

[54] COMPARTMENTALIZED FILE BOX

[76] Inventor: Lawrence W. Dworkin, 24 White Oak Dr., North Caldwell, N.J. 07006

[21] Appl. No.: 244,798

[22] Filed: Mar. 17, 1981

[51] Int. Cl.[3] ..... B65D 25/04; B65D 85/00

[52] U.S. Cl. ..... 206/425; 206/44 B; 206/561; 229/42

[58] Field of Search ..... 206/44 B, 425, 561; 40/380; 220/22; 229/42, 3.5 R, 15

[56] References Cited

U.S. PATENT DOCUMENTS

| | | | |
|---|---|---|---|
| 792,938 | 6/1905 | Smith | 206/459 |
| 1,217,243 | 2/1917 | Tucker et al. | 206/459 |
| 1,246,310 | 11/1917 | Niswanger | 40/380 |
| 1,336,584 | 4/1920 | Ringer | 40/380 |
| 1,362,960 | 12/1920 | Rand | 229/15 |
| 2,938,623 | 5/1960 | Eichorn | 206/425 |
| 3,324,918 | 6/1967 | Miller | 206/425 X |
| 3,442,039 | 5/1969 | Saizelet | 40/367 |
| 3,908,821 | 9/1975 | Lambert et al. | 206/425 |
| 3,985,284 | 10/1976 | Palsson | 229/3.5 R |

FOREIGN PATENT DOCUMENTS

| | | | |
|---|---|---|---|
| 1298933 | 7/1969 | Fed. Rep. of Germany | 229/42 |
| 836123 | 6/1960 | United Kingdom | 229/42 |
| 2014955 | 9/1979 | United Kingdom | 206/425 |

*Primary Examiner*—William Price
*Assistant Examiner*—Brenda Ehrhardt
*Attorney, Agent, or Firm*—Anthony F. Cuoco

[57] ABSTRACT

A compartmentalized file box is disclosed wherein the box has a cover (4) hinged to the back thereof and means (10), (12), (14) associated with the cover and the front of the box for securing the cover closed. A plurality of dividers (26), (28) are secured to the inside bottom (11) of the box for defining filing compartments (16), (18), (20), (22), (24). The inside of the cover of the box and the dividers may carry indicia for identifying the filed contents and for facilitating retrieval thereof.

7 Claims, 4 Drawing Figures

COMPARTMENTALIZED FILE BOX

BACKGROUND OF THE INVENTION

Compartmentalized file boxes enjoy a wide variety of uses. Commercially these boxes may be used by banks and similar institutions as money order filing boxes, sorting and filing boxes for cancelled checks and other like uses. For private purposes these boxes are useful for tax records, household bills, important papers, recipes and the like. Boxes for these purposes now known in the art include those described in U.S. Pat. No. 3,442,039 issued to Saizelet on May 6, 1969 and U.S. Pat. No. 3,908,821 issued to Lambert et al on Sept. 30, 1975.

Irrespective of the purpose of the box, it is desirable that it be sturdy, long wearing and attractive in appearance. The compartmentalized filing box herein disclosed is useful for the above described purposes and satisfies the noted criteria. Moreover, while the box herein disclosed may be used for general purposes, it is particularly useful as a working box for bank personnel and the like who dispense travellers checks. This use is occasioned by the current procedure for marketing travellers checks which involves prepackaging the checks in precounted security packaged amounts, whereby handling of individual checks is eliminated and the checks are dispensed with accuracy and efficiency.

Accordingly, it is an object of this invention to provide a sturdy, long lasting and attractive compartmentalized file box which is adaptable to a wide variety of uses, and is particularly adaptable as a working file box for dispensing prepackaged, precounted travellers checks and the like.

SUMMARY OF THE INVENTION

This invention contemplates a box having a cover moveable away from and toward the front of the box. The cover carries means for engaging the box front to secure the cover closed. A plurality of dividers are contained within the box and extend transversely thereacross. The arrangement is such that a plurality of U-shaped members have their bottoms secured to the inside bottom of the box with the sides of said members forming the transversely extending dividers. The dividers and the front and back of the box cooperate to define compartments which may be of varying widths and which are respositories for the filed material. The inside of the box cover and the dividers may carry indicia for identifying the filed material and for facilitating retrieval thereof. The structural configuration herein disclosed distinguishes the file box of the invention over boxes for like purposes now known in the art such as described by the aforenoted patents.

DETAILED DESCRIPTION OF THE INVENTION

Figure 1:
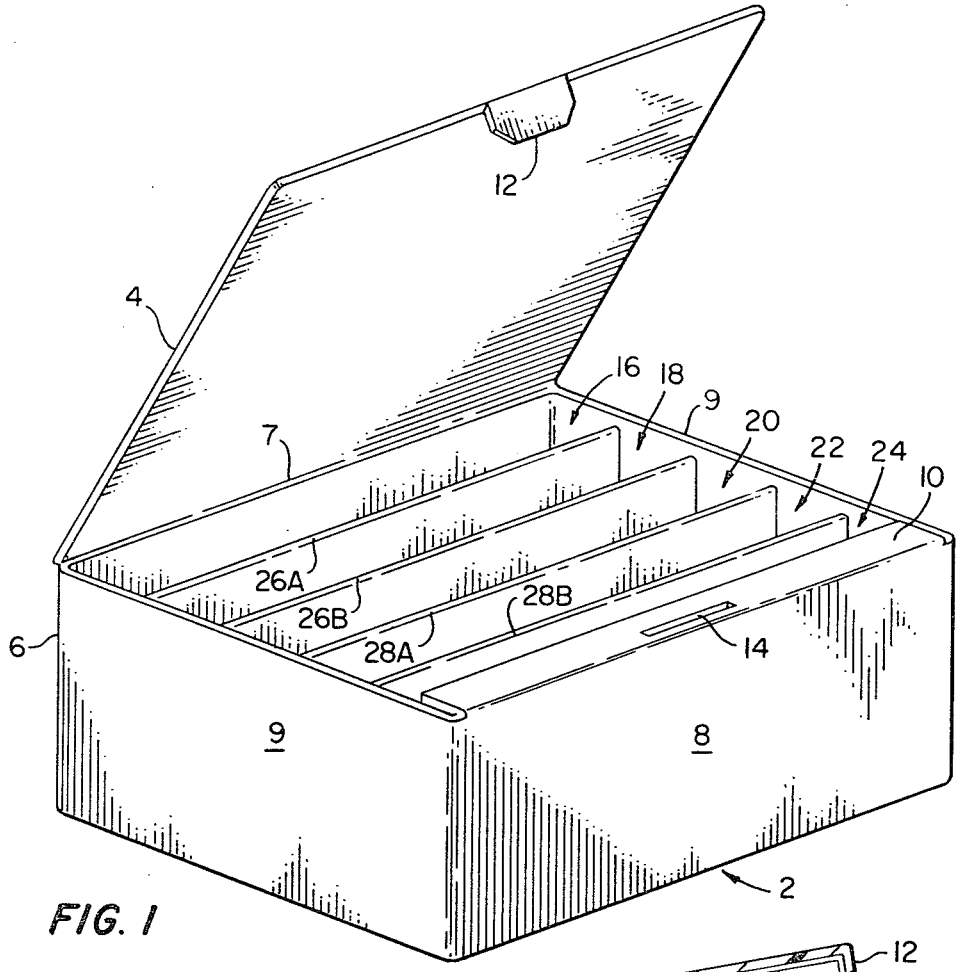
FIG. 1 is an isometric pictorial representation of a compartmentalized file box according to the invention.

With reference to FIG. 1, a rectangular compartmentalized filing box is designated generally by the numeral 2. File box 2 may be constructed for example, of a suitable rigid paperboard material or the like and covered with a colored vinyl sheet 24 which is appropriately heat sealed at its seams as will be understood by those skilled in the art.

Box 2 has a cover 4 integral with a back member 6 so that a natural hinge 7 is formed between the cover and back member, whereby the cover may be moved away from or toward a box front member 8. Box 2 has a pair of substantially parallel side members 9.

Front member 8 carries an inwardly extending ledge 10 and cover 4 carries a lip 12 which engages a slot 14 in ledge 10 for securing the cover closed. In this connection it is noted that the arrangement of lip 12 and slot 14 effectively locks cover 4 closed to prevent the contents of the box from becoming dislodged if the box is turned over or otherwise disturbed, and which feature adds to the security features of the box.

Box 2 has a plurality of compartments of varying widths, shown for illustration purposes as 5 in number and designated by the numerals 16, 18, 20, 22 and 24.

Figure 2:
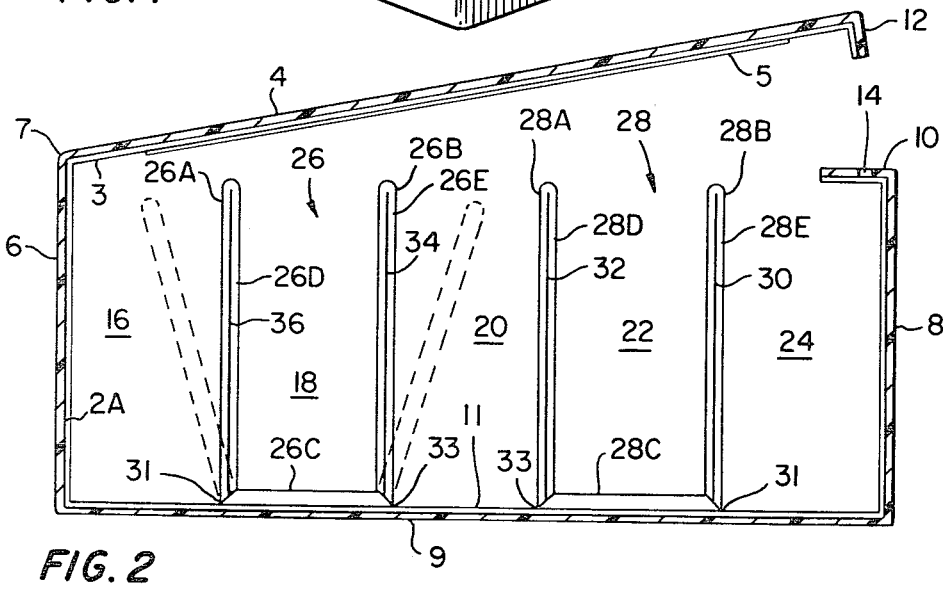
FIG. 2 is a sectional side view of the file box.

With reference to FIG. 2, compartments 16, 18, 20, 22 and 24 are formed by front and back box members 6 and 8, and by a plurality of U-shaped members shown for illustration purposes as two in number and designated by the numbers 26 and 28. Each of the U-shaped members 26 and 28 has a pair of sides 26A, 26B and 28A, 28B, respectively, which form compartment dividers, and bottoms 26C and 28C, respectively, extending transversely across the inside of box 2 (FIG. 1).

U-shaped members 26 and 28 are formed from suitable thin transparent vinyl sheets or the like, with the sides thereof integral with the bottoms for forming a natural hinge therewith so that the sides are moveable relative to the bottoms as shown in phantom in the figure.

Thus, with the arrangement shown, compartment 16 is formed by U-shaped member side 26A and back member 6 of box 2; compartment 18 is formed by sides 26A and 26B; compartment 20 is formed by sides 26B and 28A; compartment 22 is formed by sides 28A and 28B; and compartment 24 is formed by U-shaped member side 28B and front member 8 of box 2. Bottoms 26C and 28C of U-shaped members 26 and 28 are secured to the inside of bottom 9 of box 2 such as by transversely heat sealing the U-shaped member bottoms to the box bottom at 31 and 33.

U-shaped members sides 26A, 26B, 28A and 28B have pockets 26D, 26E and 28D, 28E, respectively, and which pockets have inserted therein card-like members 30, 32, 34 and 36 or the like as particularly shown in FIG. 2. Members 30, 32, 34 and 36 serve to stiffen the sides and may carry identifying indicia as will be hereinafter described, and for this purpose may be white coated paperboard, 0.024 inches thick.

After the card-like members are inserted in the pockets, the pockets may be sealed closed as by heat sealing or the like to encapsulate the members 30, 32, 34 and 36 in their respective pockets 28E, 28D, 26E and 26D.

As heretofore noted, box cover 4 on its inside surface 3 and card-like members 30, 32, 34 and 36 may carry corresponding identifying indicia to facilitate retrieval of the filed material. Since a particular use of the invention is for filing travellers checks and for facilitating dispensing thereof as heretofore noted, the identifying indicia will be next described with this use in mind.

Figure 3:
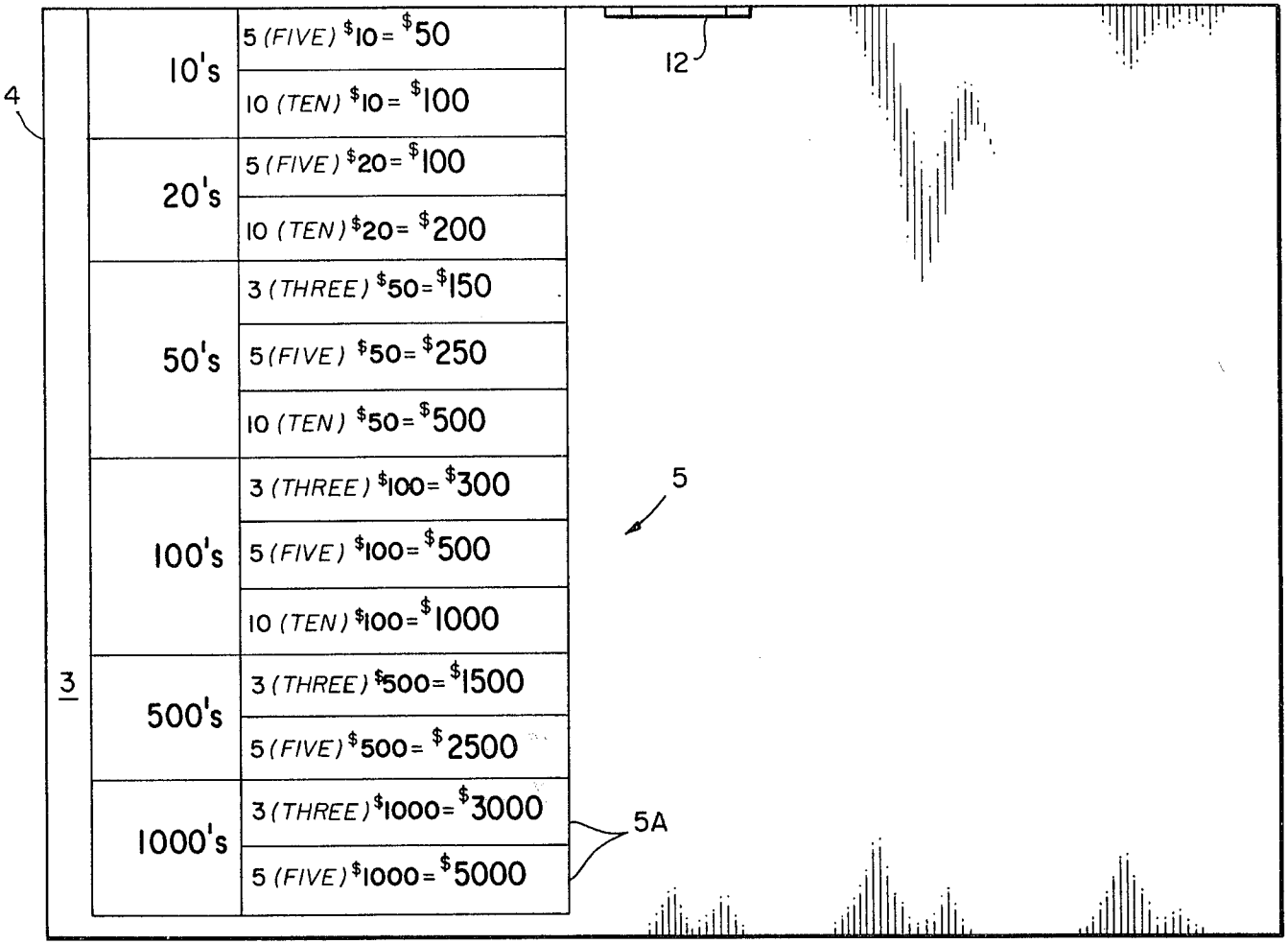
FIG. 3 is a top plan view of the inside of the file box cover, particularly showing identifying indicia thereon corresponding to the filed contents of the box.

Thus, with reference to FIG. 3, the inside surface 3 of cover 4 of box 2 may carry indicia designated generally by the numeral 5, which may, for example, be silk screened to the cover surface for indicating the number, unit value and total value of travellers checks contained within the several box compartments.

For example, compartment 24 (FIGS. 1 and 2) may contain travellers checks in one thousand dollar denominations and in precounted security packages of three, one-thousand dollar checks (total value of $3,000) or five, one-thousand dollar checks (total value of $5,000) and particularly designated as 5A in FIG. 3.

Figure 4:
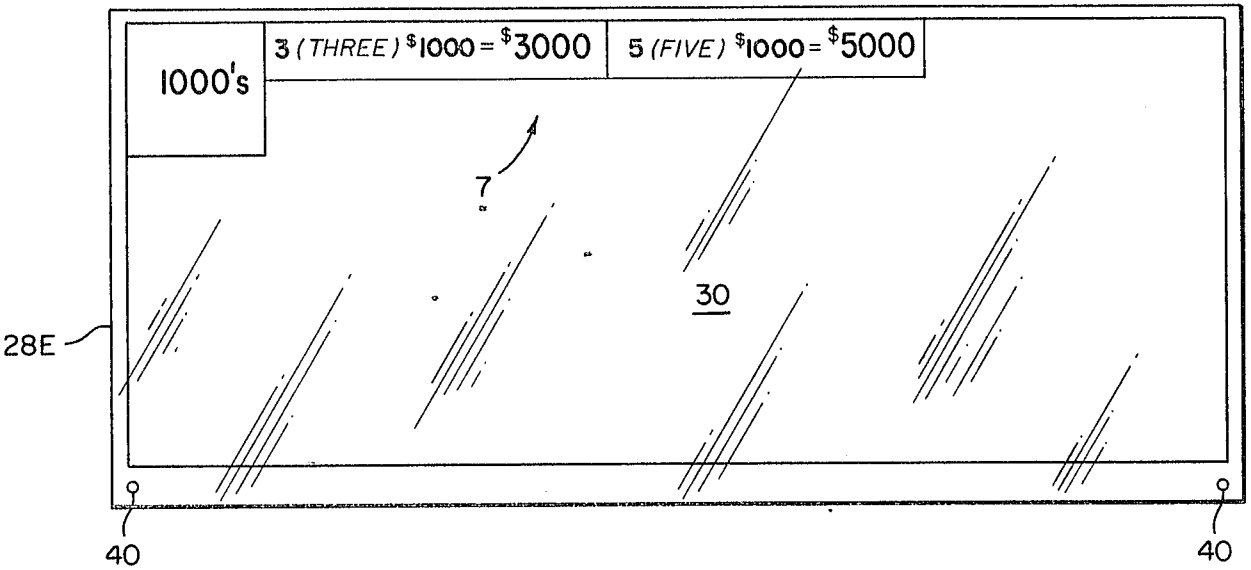
FIG. 4 is a front view of a typical file box divider particularly showing identifying indicia corresponding to the identifying indicia on the file box cover.

Card-like member 30, encapsulated in pocket 28E as shown in FIG. 4, carries corresponding indicia designated generally by numeral 7 which may be suitably printed on member 30 to identify the travellers checks filed in compartment 24. Each such card-like member 32, 34 and 36 may carry indicia identifying the contents of compartments 22, 20 and 18 respectively, and which indicia corresponds to like indicia on cover 4 as heretofore described and as will be seen from FIGS. 3 and 4. The inside surface of back 6 of box 2 has identifying indicia silk screened thereon.

In this regard it is noted that the indicia on card-like members 30, 32, 34 and 36 and back 6 of box 2, and that on cover 4 may be suitably color coded to further enhance retrieval of the filed contents of box 2.

Finally, and with further reference to FIG. 4, pocket 28E as well as the other pockets 28D, 26E and 26D may carry suitable air holes 40 whereby air is evacuated during encapsulation of the respective card-like members 30, 32, 34 and 36 to provide a smooth bubbleless surface as is desired to enhance the utility and appearance of the box and the visibility of the card-like members through the transparent pockets. In this connection it is noted that the aforenoted encapsulation of the card-like members serves to protect said members from wear and tear and environment conditions, whereby the visibility of the indicia thereon is enhanced.

There has thus been described a compartmentalized file box which may serve a variety of of uses and is particularly adapted for filing travellers checks to facilitate dispensing thereof. The filing compartments within the box are provided by an arrangement of U-shaped members having their bottoms sealed to the bottom of the box and their sides forming the required compartments. Both the inside cover of the box and members carried in pockets formed in the U-shaped member sides may carry color coded indicia to facilitate retrieval of the filed contents.

Having thus described the invention, what is claimed is:

1. A compartmentalized file box, comprising:

a rectangular box having front, back, bottom and a pair of side members;

a cover formed with the back member so as to be integrally hinged thereto for opening and closing the cover;

means associated with the cover and the front member for securing the cover closed;

a plurality of U-shaped members each having a bottom and a pair of sides disposed within the box and extending transversely from near one box side member to near the other;

the bottoms of the U-shaped members being secured to the bottom of the box and the sides of said members cooperating with each other and with the front and back box members for forming a plurality of filing compartments within the box;

the sides of the U-shaped members and the inside of the back box member, and the inside cover of the box, carrying corresponding indicia for identifying the filed contents of the box and for facilitating retrieval thereof;

the sides of the U-shaped members are thin, flexible and transparent, and have pockets therein;

card-like members are encapsulated within the pockets for stiffening the sides of the U-shaped members;

the card-like members carry the indicia for identifying the filed contents of the box and for facilitating retrieval thereof, and the encapsulation of the card-like members within the pockets protecting said members from wear and tear and from environmental conditions; and the pockets having holes therein whereby air is evacuated during encapsulation of the card-like members.

2. A compartmentalized file box as described by claim 1, wherein:

the corresponding identifying indicia carried by the sides of the U-shaped members and the inside of the back member, and the inside cover of the box, is color coded for enhancing the identification of the filed contents of the box and for facilitating the retrieval thereof.

3. A compartmentalized file box as described by claim 1, wherein:

the sides of the U-shaped members are formed with the bottom members so as to be integrally hinged thereto for angular displacement of the sides away from and toward the bottom members.

4. A compartmentalized file box as described by claim 1, wherein the means associated with the cover and the front member for securing the cover closed includes:

a ledge extending inwardly from the front member and substantially normal thereto;

a slot carried by the ledge;

a lip extending downward from the cover and substantially normal thereto; and the lip engaging the slot when the cover is closed for securing the cover closed.

5. A compartmentalized file box, comprising:

a rectangular box of a relatively rigid material and having front, back, bottom and a pair of side members, and covered with a thin, flexible sheet-like material;

a cover hinged to the back member through an integral hinge and covered with the thin, flexible sheet-like material;

the front member including a ledge extending inwardly therefrom and substantially normal thereto;

a slot carried by the ledge;

a lip extending downward from the cover and substantially normal thereto, and engaging the slot when the cover is displaced about the hinge to close the box, whereupon the cover is secured closed;

a plurality of U-shaped members of a thin, flexible and transparent material, each having a bottom and a pair of sides and disposed within the box and extending transversely from near the other side member;

the bottoms of the U-shaped members secured in the bottom of the box and the sides of said members cooperating with each other and with the front and back box members for forming a plurality of filing compartments of varying widths within the box;

the sides of the U-shaped members being hinged to the bottoms thereof through an integral hinge so as to be angularly displaceable away from and toward the bottoms, and said sides having pockets therein;

card-like members encapsulated within the pockets for stiffening the sides of the U-shaped members;

the card-like members and the inside of the back box member and the inside cover of the box carrying indicia for identifying material filed within the box compartments and for facilitating retrieval thereof, and the encapsulation of the card-like members within the pockets protecting said members from wear and tear and from environmental conditions; and the pockets having holes therein whereby air is evacuated during encapsulation of the card-like members.

6. A compartmentalized file box as described by claim 1, wherein:

the plurality of compartments are of varying widths.

7. A compartmentalized file box as described by claim 5, wherein:

the thin, flexible sheet-like material is a colored vinyl; and the thin, flexible and transparent material is vinyl.

* * * * *